US006825812B2

(12) United States Patent
Yokota et al.

(10) Patent No.: US 6,825,812 B2
(45) Date of Patent: Nov. 30, 2004

(54) ANTENNA STRUCTURE FOR VEHICLES

(75) Inventors: Makoto Yokota, Toyota (JP); Minoru Yonebayashi, Toyota (JP); Hideaki Tanaka, Okazaki (JP); Junzo Ooe, Aichi-ken (JP); Kansei Mizutani, Nisshin (JP); Kohji Tabata, Aichi (JP); Hidetoshi Oka, Osaka (JP); Naoki Kushima, Kobe (JP)

(73) Assignees: Kojima Press Industry Co., LTD, Toyota (JP); Toyota Jidosha Kabushiki Kaisha, Toyota (JP); Asahi Glass Company, Limited, Toyota (JP); Nippon Sheet Glass Company, Osaka (JP); Fujitsu Ten Limited, Kobe (JP)

( * ) Notice: Subject to any disclaimer, the term of this patent is extended or adjusted under 35 U.S.C. 154(b) by 33 days.

(21) Appl. No.: 10/446,736

(22) Filed: May 29, 2003

(65) Prior Publication Data

US 2003/0227413 A1 Dec. 11, 2003

(30) Foreign Application Priority Data

May 29, 2002 (JP) ..... 2002-155480

(51) Int. Cl.[7] ..... H01Q 1/32
(52) U.S. Cl. ..... 343/713; 343/711
(58) Field of Search ..... 343/713, 711, 343/712, 906

(56) References Cited

U.S. PATENT DOCUMENTS

| | | | | |
|---|---|---|---|---|
| 6,025,806 A | | 2/2000 | Deininger et al. | 343/713 |
| 6,087,996 A | * | 7/2000 | Dery | 343/713 |
| 6,411,259 B1 | | 6/2002 | Wendt et al. | 343/713 |

FOREIGN PATENT DOCUMENTS

| | | |
|---|---|---|
| DE | 23 28 167 A | 12/1974 |
| DE | 198 23 202 A 1 | 12/1999 |
| EP | 0 791 975 A2 | 8/1997 |
| EP | 0 899 810 A2 | 3/1999 |
| EP | 1 109 248 A1 | 6/2001 |
| JP | A 9-23112 | 1/1997 |
| JP | A 10-56317 | 2/1998 |
| JP | A 10-341104 | 12/1998 |
| JP | A 2001-313508 | 11/2001 |

* cited by examiner

*Primary Examiner*—Hoang V. Nguyen
(74) *Attorney, Agent, or Firm*—Oliff & Berridge PLC

(57) ABSTRACT

An antenna structure for vehicles capable of minimizing the distance between a first contact member and a signal processing circuit and ensuring stable antenna performance without using a connection line of a lengthy wire rod is provided. To realize this advantage, an antenna element is disposed on a rear window glass, and the first contact member is disposed at an end of the antenna element. Further, an amplifier case having an attachment flange facing the rear window glass is fixed to a roof panel, and the signal processing circuit is disposed in the amplifier case at a position sandwiching the attachment flange.

9 Claims, 9 Drawing Sheets

ANTENNA STRUCTURE FOR VEHICLES

BACKGROUND OF THE INVENTION

1. Field of the Invention

The present invention relates to a vehicle-mounted antenna structure, and more particularly to an antenna structure having an antenna element printed on window glass of the vehicle.

2. Description of the Related Art

Vehicle antenna structures formed through a method in which an antenna element is printed on a rear window glass of a vehicle have been known and widely employed.

Although, in view of antenna performance, it is most preferable that an antenna element is exposed to the outside of a vehicle on which the antenna is mounted, antenna structures as described above are employed because projecting or whip antennas mounted on the outside of a vehicle body, such as a straight antenna projecting upward from an upper corner of a bumper or a fender of the vehicle and a straight antenna projecting diagonally rearward from a front pillar of the vehicle, can be obstacles to washing of the vehicle and may generate wind noise at certain speeds.

Further, because it is preferable for a straight antenna attached to the bumper or the fender of the vehicle to telescope from an unused contracted position when used and to return when not in use, the antenna must be motorized.

While a straight antenna mounted on the front pillar of the vehicle can be extended or contracted by a driver reaching the antenna from inside, and therefore advantageously eliminates the need for a motor mechanism for extending and returning the antenna at the start and end of use, because the tip of the extended antenna is higher than the roof of the vehicle, their is a danger of the antenna striking a low archway, tunnel, or the like.

In contrast, a glass antenna as described overcomes various problems of such straight antennas, improves directivity of radio waves, and advantageously excels in versatility, such as providing diversity system.

FIG. 1 is a cross sectional view illustrating part of an example vehicle antenna structure formed through a method of manufacturing a laminated glass antenna as described above (see Japanese Patent Laid-Open Publication No. Hei 10-56317). Hereinafter, all such methods for manufacturing laminated glass antennas will be referred to simply as "glass antenna methods".

Referring to FIG. 1, a packing 3 is sandwiched between a rear edge of a roof panel 1 and a front edge of a rear window glass 2. In this specification, positional expressions, such as front, rear, upper, lower, above, and below, refer to such positions with respect to the vehicle, as understood by a driver or occupant of the vehicle. An additional antenna element, not shown, is disposed on the rear window glass 2 on the cabin side of the vehicle. An antenna unit 4 is disposed inside the cabin.

The antenna unit 4 includes a first contact member 5 disposed on the rear window glass 2 and forming part of the antenna element, a signal processing device 6 packaged in a case fixed to the roof panel 1 on the cabin side, an electrically connecting conductor 7 extending from the signal processing device 6, a supporting member 9 having a contact strip 8 resiliently contacting the first contact member 5, and serving as a second contact member, and other components. The contact strip 8 can be integrally formed by, for example, cutting and shaping the tip of the electrically connecting conductor 7.

The antenna element is connected to an amplifier for processing a received signal through a connection line, which is a conductor electrically undistinguished from the antenna element. As a result, the connection line also substantially functions as an antenna element, whereby transmission and reception cannot be well performed at the originally intended reception frequency band of the antenna element.

While an approach of designing an antenna element that includes a connection line is possible, the distance between the amplifier and the antenna element generally varies according to vehicle model, configuration, and the like, such that the length of the connection line and the positional relationship are widely varied, resulting in considerable variation in reception performance of the antenna, thereby requiring readjustment, setting, and other steps to reduce the variation. Thus, designing an antenna element that includes the connection line is difficult in practice.

Further, even more impractically, the connection lines are not appropriate elements for receiving a signal from outside the cabin because they are mostly in the cabin, and therefore pickup noise within the cabin, adversely affecting the antenna performance.

In view of the above, in the configuration illustrated in FIG. 1, the signal processing device 6 having an amplifier is attached to the roof panel 1 serving as a ceiling of the vehicle, thereby minimizing the distance to the first contact member 5 serving as the antenna element, and using a coaxial cable or a microstrip line for the electrically connecting conductor 7, i.e. the connection line, in order to overcome the above-described problems.

The vehicle antenna structure configured as described above, however, has an additional problem in that the connection configuration is complicated because a coaxial cable or a microstrip line must be used for the electrically connecting conductor 7 (including the supporting member 9) serving as the connection line.

Although the microstrip line is provided for impedance matching, the length required for this function is not necessarily the same as the actual distance between the antenna element and the amplifier. When the lengths differs, the microstrip line and the amplifier must be connected with a coaxial cable, thereby further complicating the connection configuration. In addition, leakage from the microstrip line and its unintended function as an antenna are unavoidable.

SUMMARY OF THE INVENTION

In order to solve the above-described problems, the present invention advantageously provides an antenna structure for a vehicle capable of minimizing the distance between a first contact member and a signal processing circuit, and therefore ensuring stable antenna performance without using a connection line of a lengthy wire rod.

To realize this advantage, an antenna structure for a vehicle according to one embodiment of the present invention comprises an antenna element disposed on a window glass of the vehicle, a first contact member disposed at an end of said antenna element, an amplifier case fixed to a body panel of the vehicle, and having at least a portion facing said window glass, and a signal processing circuit disposed in said amplifier case at the portion facing said window glass, and connectable to said first contact member.

In the above configuration, the antenna element is disposed on the window glass of the vehicle, the first contact member is disposed at an end of the antenna element, the amplifier case having at least a portion facing the window glass is fixed to the body panel of the vehicle, and the signal processing circuit is disposed in the amplifier case at the portion facing the window glass.

As a result, it is possible to ensure that the first contact member and the signal processing circuit face each other with minimum distance therebetween, sandwiching the portion of the amplifier case facing the window glass of the vehicle, thereby achieving electrical contact between the first contact member and the signal processing circuit with the minimum distance without using a connection line formed of a wire rod.

In other words, because the distance between the first contact member and the signal processing circuit can be minimized, stable antenna performance can be ensured without using a connection line formed of a lengthy wire rod.

Said first contact member and said signal processing circuit may be electrically connected through a second contact member formed of a conductive piece.

Said second contact member may be resilient.

Said second contact member may be formed as an elastic bellows.

Said second contact member may be made to contact said first contact member by a conductive pressing element.

Said pressing element may be a coil spring.

Said amplifier case may be a shield case for preventing adverse effects of noise on at least said signal processing circuit.

Said second contact member may be covered with a protective member formed of an insulating material.

A conductive rubber may be disposed between said first and second contact members.

DESCRIPTION OF THE PREFERRED EMBODIMENTS

Preferred embodiments of an antenna structure for vehicles according to the present invention will next be described with reference to the drawings.

[First Embodiment]

Figure 1:
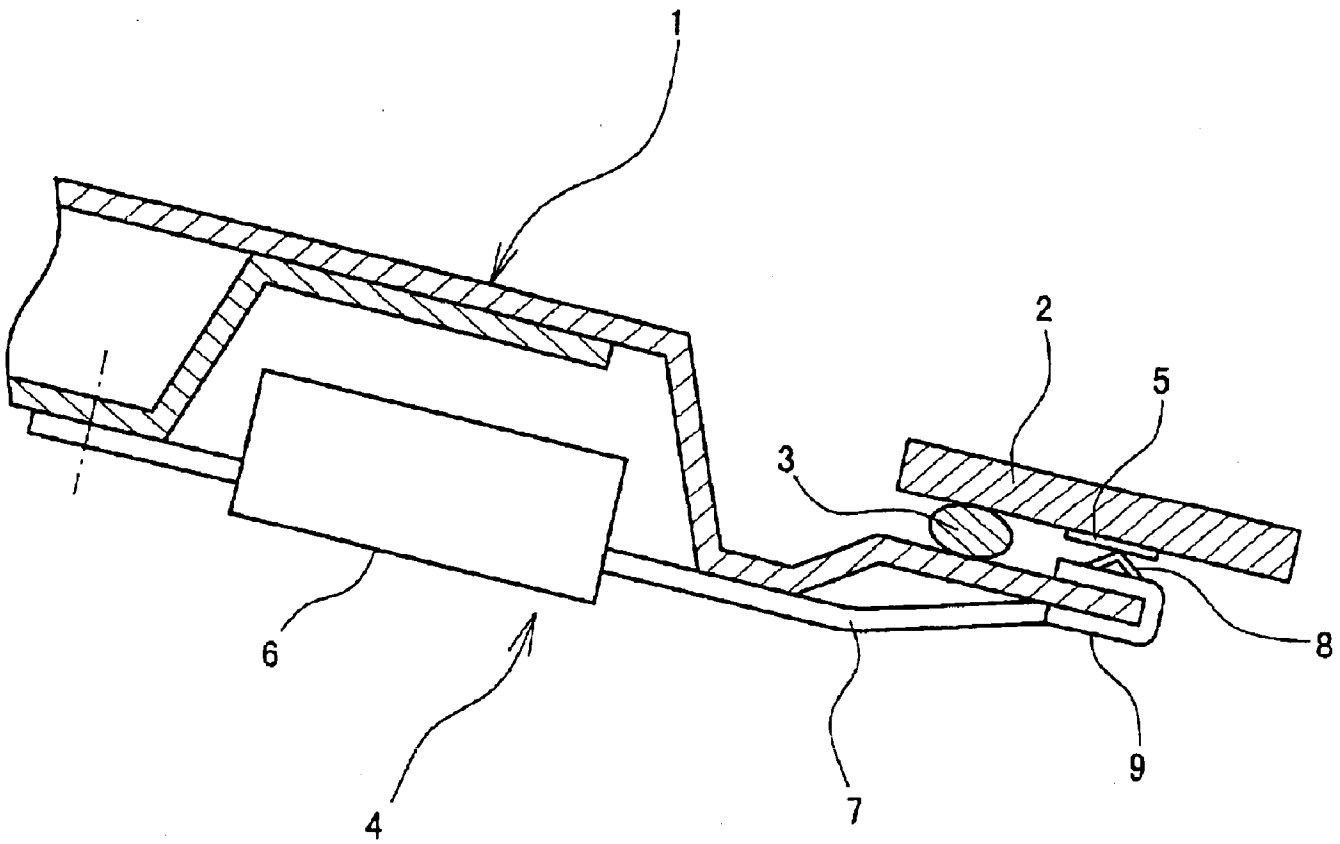
FIG. 1 is a cross sectional view illustrating key elements of an antenna structure for a vehicle according to a related art.
Figure 2A:
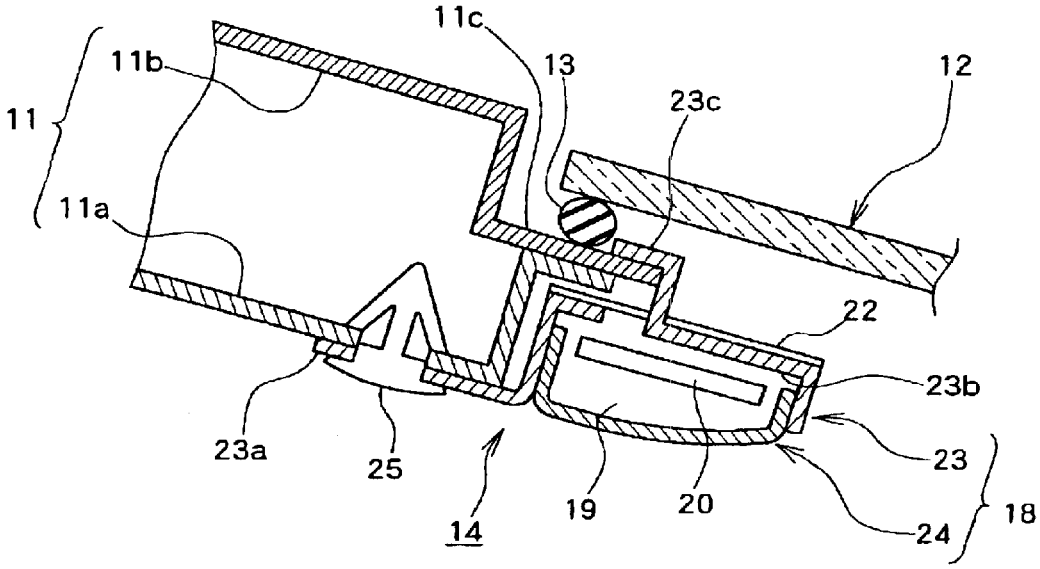
FIG. 2A is a cross sectional view illustrating key elements of an antenna structure for a vehicle according to a first embodiment of the present invention.
Figure 2B:
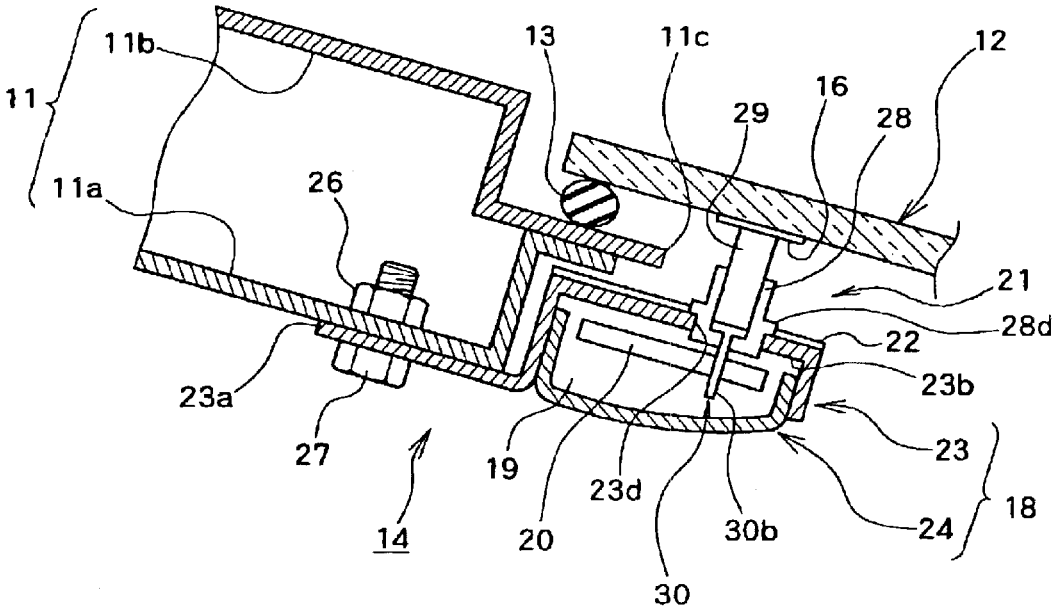
FIG. 2B is a cross sectional view illustrating additional key components of the antenna structure for a vehicle according to the first embodiment of the present invention.
Figure 3:
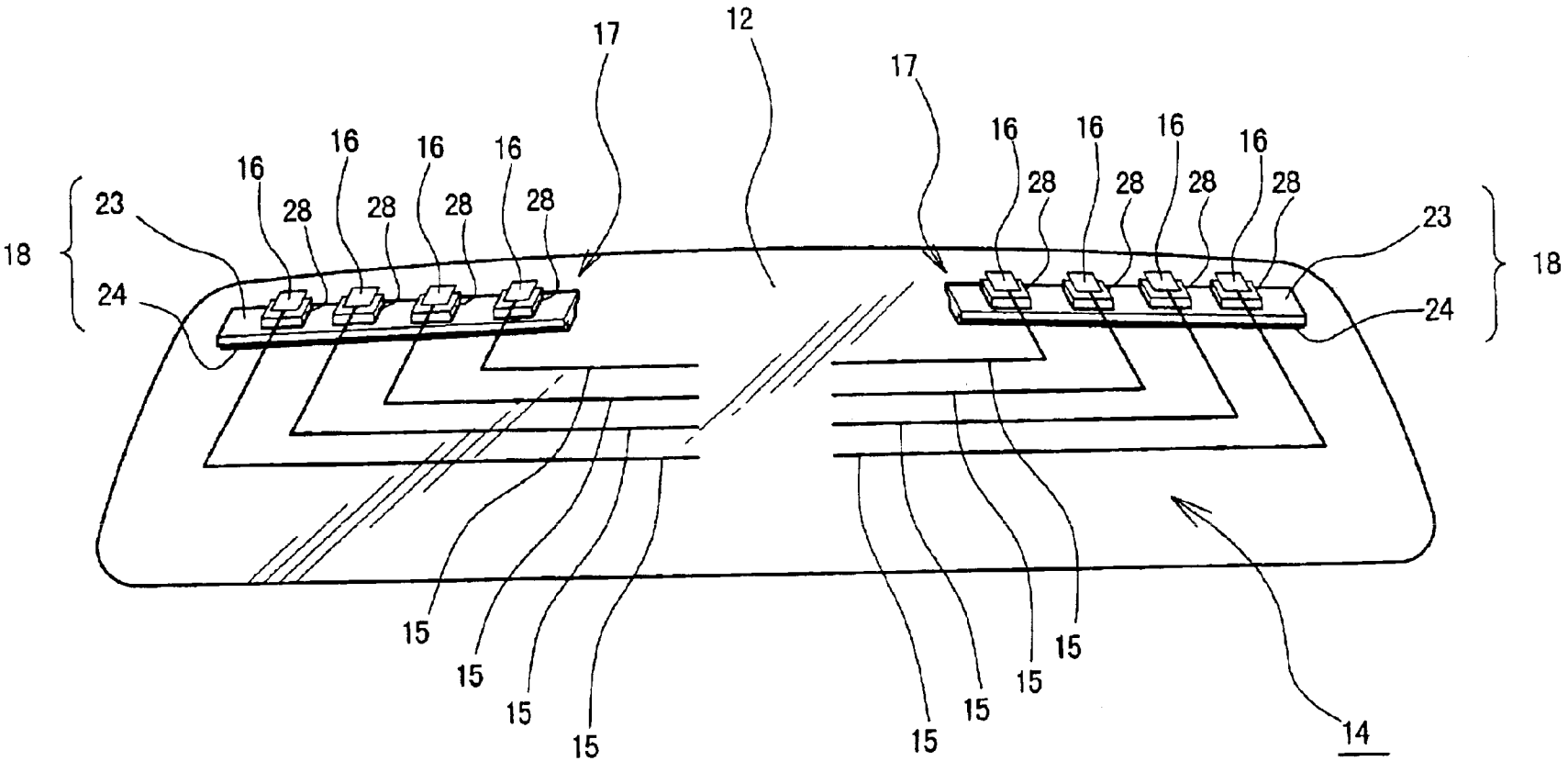
FIG. 3 is a front view of a rear window glass of the vehicle having an antenna element disposed thereon in the antenna structure for a vehicle according to the first embodiment of the present invention.
Figure 4A:
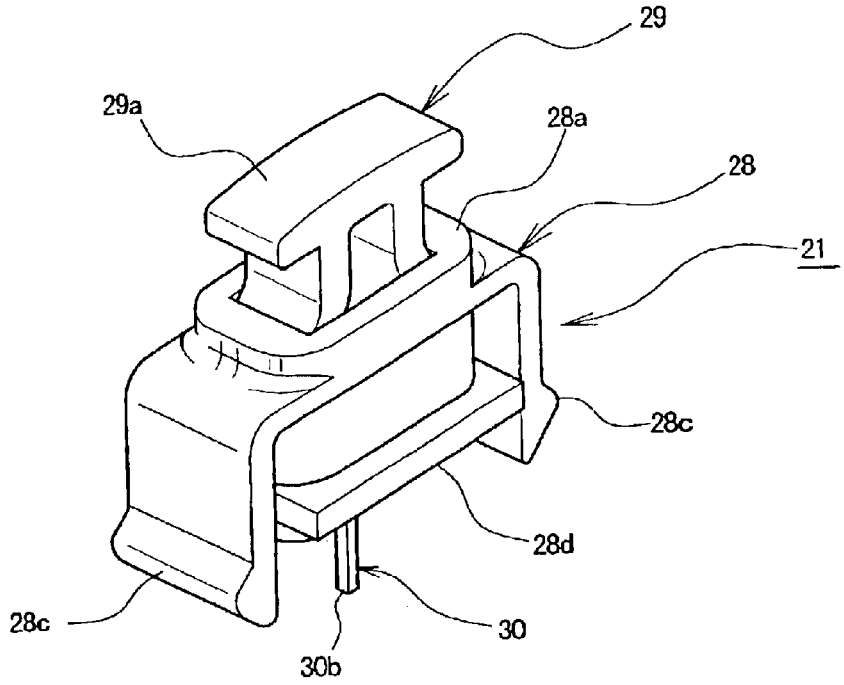
FIG. 4A is a perspective view of a feeding member in the antenna structure for a vehicle according to the first embodiment of the present invention.
Figure 4B:
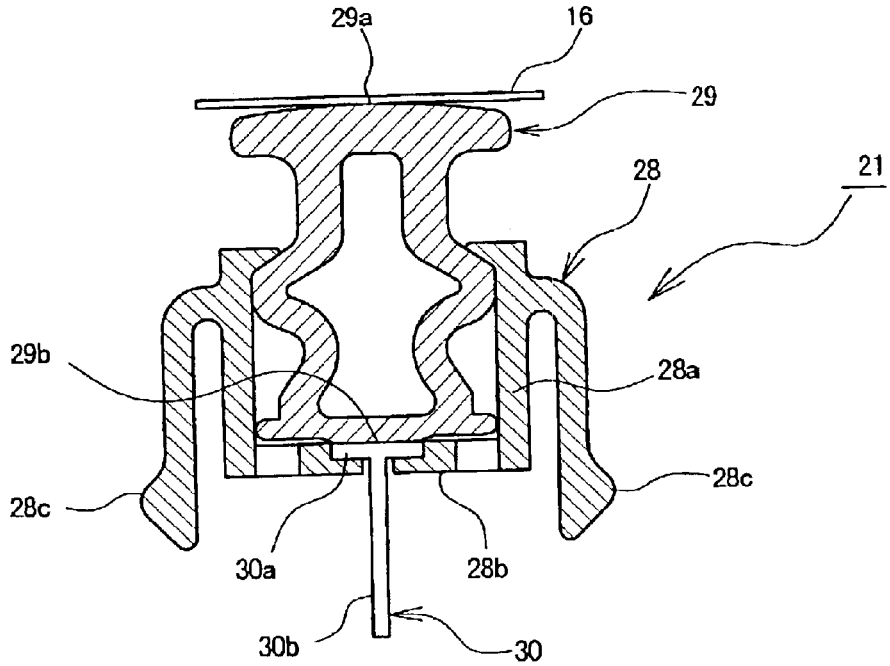
FIG. 4B is a cross sectional view of the feeding member in the antenna structure for a vehicle according to the first embodiment of the present invention.

FIG. 2A through FIG. 4B illustrate a first embodiment of a vehicle antenna structure according to the present invention. FIG. 2A is a cross sectional view illustrating key components of the vehicle antenna structure according to the first embodiment, FIG. 2B is a cross sectional view illustrating another part of the vehicle antenna structure, FIG. 3 is a front view of a rear window glass of the vehicle having an antenna element disposed thereon, and FIGS. 4A and 4B are a perspective view and a cross sectional view, respectively, illustrating a feeding member.

Referring to FIGS. 2A and 2B, a roof panel 11 (only a part thereof is shown) as a vehicle's body panel is composed of an inner panel 11*a* and an outer panel 11*b*. A packing (or adhesive) 13 is sandwiched by the front edge of the rear window glass 12 as a vehicle window glass and the rear edge of the roof panel 11 at the overlapping portion. An antenna unit 14 is disposed in the cabin (located on the lower side of the figure).

Referring to FIG. 3, the antenna unit 14 includes a plurality of antenna elements 15 printed on the rear window glass 12 on the cabin side and used by, for example, TV, radio, wireless door lock control devices, a first contact member 16 provided at each end of the antenna element 15 and collectively arranged near the upper edge of the rear window glass 12, and a pair of feeding units 17 disposed on the right and left sides of the vehicle.

In FIG. 3, each set of four antenna elements 15 is disposed on the right and left sides of the vehicle, and the first contact members 16 are correspondingly arranged on the upper side. This arrangement facilitates element design for realizing diversity. Therefore, the feeding units 17 are spaced apart from the center of the vehicle with respect to its width, and located toward the right and left edges of the vehicle.

Because the feeding units 17 are substantially identical, only the feeding unit 17 on one side will be described below. It should be noted that the number of antenna elements 15 is not limited, and are arranged in accordance with antenna function and the like.

The feeding unit 17 includes an amplifier case 18 fixed to the inner panel 11*a* on the cabin side, a signal processing circuit (printed circuit board) 20 disposed in an inner space 19 of the amplifier case 18, a feeding member 21 disposed opposite to and under the first contact member 16, and an insulating sheet 22.

The amplifier case 18 includes a base 23 having a step-like cross section, and a cover 24 held by the base 23. The amplifier case 18 functions as a shield case for preventing noise from within the cabin from reaching the signal processing circuit 20. For such a shield case function, the base 23 and the cover 24 may be formed of a metal, or may have a resin surface with a conductor applied on the entire surface. The metal components contribute to a simplified configuration and more reliable connection between the vehicle and the ground. For such ground connection, the signal processing circuit 20 and the inner panel 11*a* may be connected directly or through the amplifier case 18 functioning as a shield case. When the ground connection is made through the amplifier case 18 or the like, the connection is preferably made in a solid manner by soldering or the like for ensuring anti-vibration properties.

The base 23 forms a stepped shape with an attachment flange 23*b* provided at an upper position of the vehicle to face the rear window glass 12 at a rearward position of the vehicle with respect to a fixed flange 23*a* positioned frontward of the vehicle. The base 23 is held by the inner panel 11*a* by temporarily fixing the fixed flange 23*a* to the inner panel 11*a* with a clip 25 and then screwing a bolt 27 to a nut 26 fixed to the inner panel 11*a*. The fixed flange 23*a* of the base 23 includes a crook 23*c* raised from the flange 23*a* for engaging with a flange 11*c* of the outer panel 11*b* for positioning and preventing a fall.

The base 23 and the cover 24 are covered with a roof trim (not shown) held by the roof panel 11 spaced apart from and placed below the inner panel 11*a* (on the cabin side) so that they cannot be seen from the cabin. The bolt 27 can connect the signal processing circuit 20 to the ground by electrically connecting to the signal processing circuit 20 (through cable connection or the like).

As illustrated in FIGS. 4A and 4B, the feeding member 21 includes a holder 28, a second contact member 29 held in an ellipsoidal cylinder 28*a* of the holder 28 and serving as an elastic and electrically conductive piece, and a coupling member 30 held in a bottom wall 28*b* of the holder 28.

A lance-shaped leg 28*c* is integrally formed with the holder 28 for engaging a rim of an opening 23*d* in the attachment flange 23*b* opposite thereto (in the width direction of the vehicle in this embodiment). In the outer periphery of the ellipsoidal cylinder 28*a*, a positioning flange 28*d* is integrally formed abutting an upper surface of the attachment flange 23*b* when the leg 28*c* is engaged with the opening 23*d* and the tip is located in the inner space 19 to attach the holder 28 to the base 23. The holder 28 exposes the tip of the second contact member 29, and is formed of an insulating resin material, such as POM (polyacetal) or ABS (acrylonitrile-butadiene-styrene), for ensuring electrical insulation of areas other than the exposed portion.

The second contact member 29 is formed of an electrically conductive resilient material, such as a conductive rubber, as an elastic bellows, so that its exposed end surface 29*a* resiliently contacts the first contact member 16 to ensure electrical connection.

The coupling member 30 formed of a conductive material includes a head 30*a* contacting a lower end surface 29*b* of the second contact member 29 to ensure electrical connection, and a leg 30*b* extending from the head 30*a* through the bottom 28*b* and connected to the signal processing circuit 20.

The insulating sheet 22 is attached to the entire upper surface of the attachment flange 23*b* to cover the opening portion created by forming the crook 23*c* in the base 23, and is formed of a plastic material, such as PC (polycarbonate) and PP (polypropylene), for preventing capacitive coupling between the second contact member 29 and the base 23.

In the above-described configuration, the antenna element 15 and the first contact member 16 are integrally formed through printing onto the rear window glass 12 to ensure electrical connection before the vehicle is assembled.

To the base 23 formed in advance in a predetermined shape by metal pressing or injection molding, the signal processing circuit 20 is fixed and the cover 24 is mounted.

The cover 24 is fixed to the base 23 by, for example, screws and bolts, thereby preventing entry of dust, noise, and the like into the inner space 19 from the cabin.

Further, the feeding member 21, the insulating sheet 22, and the clip 25 are attached to the base 23 in advance, so that the feeding unit 17 is temporarily attached to the roof panel 11 by engaging the clip 25 to the inner panel 11*a* with the crook 23*c* engaged with the flange 11*c*. The clip 25 may be attached to the base 23 when temporarily attached to the roof panel 11.

From this state the bolt 27 is screwed to the nut 26, thereby fixing the feeding unit 17 to the roof panel 11, or the configuration of the bolt 27 and the nut 26 may be reversed.

When the feeding unit 17 is temporarily held by the roof panel 11, the second contact member 29 resiliently contacts the first contact member 16.

The first and second contact members 16 and 29 have a relatively large contact area, thereby absorbing errors (molding and mounting errors) in the substantially horizontal surface of the vehicle when the feeding unit 17 is fixed to the roof panel 11. Further, because the second contact member 29 is extensibly resilient, errors (molding and mounting errors) in the surface in the substantially vertical direction of the vehicle can be absorbed.

As a result, connection between the first and second contact members 16 and 29 can easily be ensured simply by fixing the feeding unit 17 to the roof panel 11. In addition, because the feeding unit 17 is disposed directly under the first contact member 16, there is no need to provide a lengthy cabling path of a coaxial cable, microstrip line, or the like.

The signal received by the antenna element 15 is supplied to the signal processing circuit 20 through the first and second contact members 16 and 29, and the coupling member 30. The second contact member 29 and the signal processing circuit 20 may be directly connected without disposing the coupling member 30. Alternatively, a projecting contact member may be provided in the signal processing circuit 20 in place of the coupling member 30, and directly connected to the first contact member 16 by the second contact member 29.

Thus, the coupling member 30 is used as an intermediary member for adjusting a significant difference between various types of vehicles resulting from the differing overall thickness of the roof panel 11 and the like. In addition to eliminating the need for complicated cable work and provision of cable paths, the direct connection between the first contact member 16 and the signal processing circuit 20 can be substantially maintained by just the second contact member 29 without significantly changing the length of the cabling path.

As a result, a simple connection, i.e. connection without cables (a substantially direct connection), can be achieved without a lengthy cabling path of a coaxial cable, microstrip line, or the like, without adversely affecting the received frequency band.

As described above, with the antenna structure of the first embodiment, in the feeding device for feeding electric power to the antenna element 15 mounted on the rear window glass 12, the signal processing circuit 20 is disposed closer to the rear window glass 12 than the flange 11*c* for fixing the rear window glass 12 to the roof panel 11, namely the vehicle body, i.e. disposed below the rear window glass 12, thereby achieving electrical connection between the first contact member 16 on the rear window glass 12 and the signal processing circuit 20 with the second contact member 29.

Further, the first contact member 16 and the signal processing circuit 20 are integrally connected to the feeding member 21 (a unit product) in a direct manner, thereby suppressing adverse effects as might be caused by external high frequency noise between the second contact member 29 and the signal processing circuit 20. Consequently, a highly versatile antenna structure can be achieved with a simple and inexpensive configuration.

The second contact member 29 of a conductive material may be held in the holder 28 formed of an insulating resin material, such as POM and ABS, to ensure electrical insulation from the outside except for the exposed portion.

Further, the second contact member 29 may be formed of an elastic and resilient component, thereby allowing easy absorption of possible errors, such as molding and mounting errors, between the first contact member 16 already printed on the rear window glass 12 mounted onto the vehicle in advance and the feeding unit 17 mounted later onto the inner panel 11*a*.

It is also naturally possible to achieve a contact structure absorbing the molding errors, mounting errors, and the like, when the rear window glass 12 is mounted onto the roof panel 11 after the feeding unit 17 is mounted onto the inner panel 11*a*.

In addition, the base 23 includes the crook 23*c* engaging with the flange 11*c* formed at the outer panel 11*b*, thereby absorbing displacement in the relative position between the roof panel 11 and the feeding unit 17 caused by errors in the vehicle body dimensions, mounting dimensions, and the like. Further, instantaneous displacement due to, for example, vibration during traveling of the vehicle, can be adjusted, thereby preventing generation of noise caused by possible chattering between the exposed end surface 29*a* of the second contact member 29 and the first contact member 16.

[Second Embodiment]

Figure 5A:
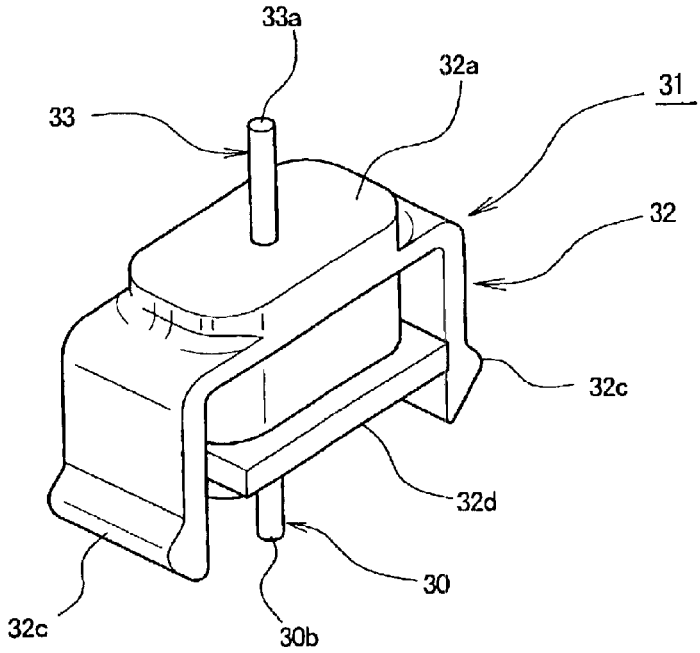
FIG. 5A is a perspective view of a feeding member in an antenna structure for a vehicle according to a second embodiment of the present invention.
Figure 5B:
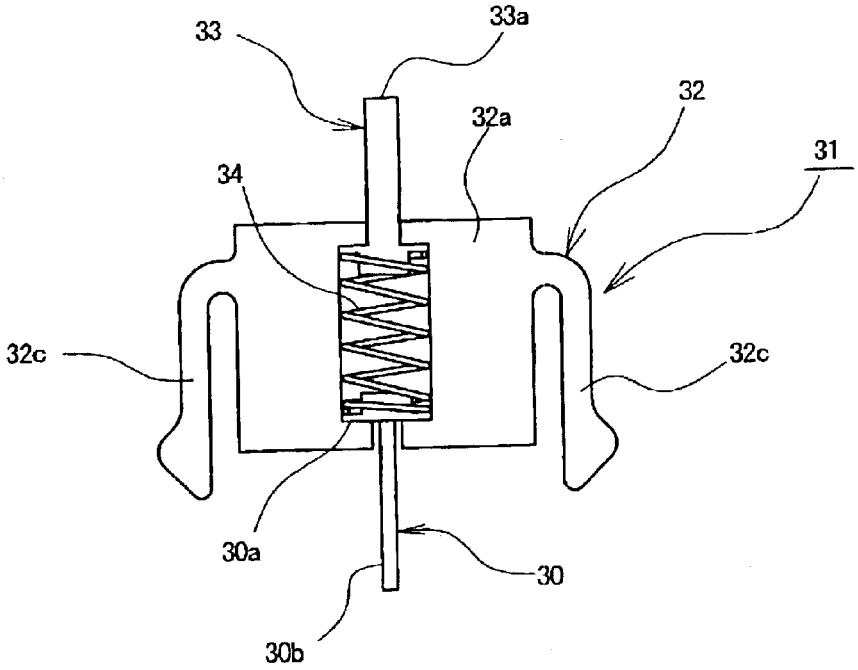
FIG. 5B is a cross sectional view of the feeding member in the antenna structure for a vehicle according to the second embodiment of the present invention.

FIGS. 5A and 5B illustrate a second embodiment of an antenna structure according to the present invention. FIG. 5A is a perspective view of the feeding member, and FIG. 5B is a cross sectional view thereof. The configurations other than those illustrated in FIGS. 5A and 5B are the same as those in the first embodiment.

In the first embodiment, the feeding member 21 is composed of the holder 28, the elastic second contact member 29 held in the ellipsoidal cylinder 28*a* of the holder 28, and the coupling member 30 held in the bottom wall 28*b* of the holder 28.

On the other hand, a feeding member 31 of the second embodiment includes a holder 32, a second contact member 33 serving as a pin-shaped conductive piece held in an ellipsoidal cylinder 32*a* of the holder 32, and a coil spring 34 provided between the second contact member 33 and the coupling member 30. Such a configuration contributes to reduction in component cost compared to the cost when the second contact member 29 is configured from a conductive material formed into a bellows, as in the first embodiment.

A lance-shaped leg 32*c* is integrally formed with the holder 32 for engaging with a rim of the opening 23*d* formed in the attachment flange 23*b* and located opposite thereto (in the width direction of the vehicle in this embodiment). In an outer periphery of the ellipsoidal cylinder 32*a*, a positioning flange 32*d* is integrally formed abutting the upper surface of the attachment flange 23*b* when the leg 32*c* is engaged with the opening 23*d* and the tip is positioned in the inner space 19 to attach the holder 32 to the base 23. The holder 32 exposes the tip of the second contact member 33, and is formed of an insulating resin material, such as POM and ABS, to ensure electrical insulation from the outside except for the exposed portion.

The second contact member 33 is formed of a conductive material and has a substantially T-shaped cross section. When pressed by the coil spring 34, a tip surface 33*a* of the contact member 33 contacts the first contact member 16 to secure electrical connection.

The coupling member 30 formed of a conductive material secures electrical connection with the second contact member 33 through the coil spring 34.

By thus configuring the feeding member 31, the same effects as those of the feeding member 21 of the first embodiment can be obtained with an inexpensive component configuration.

[Third Embodiment]

Figure 6:
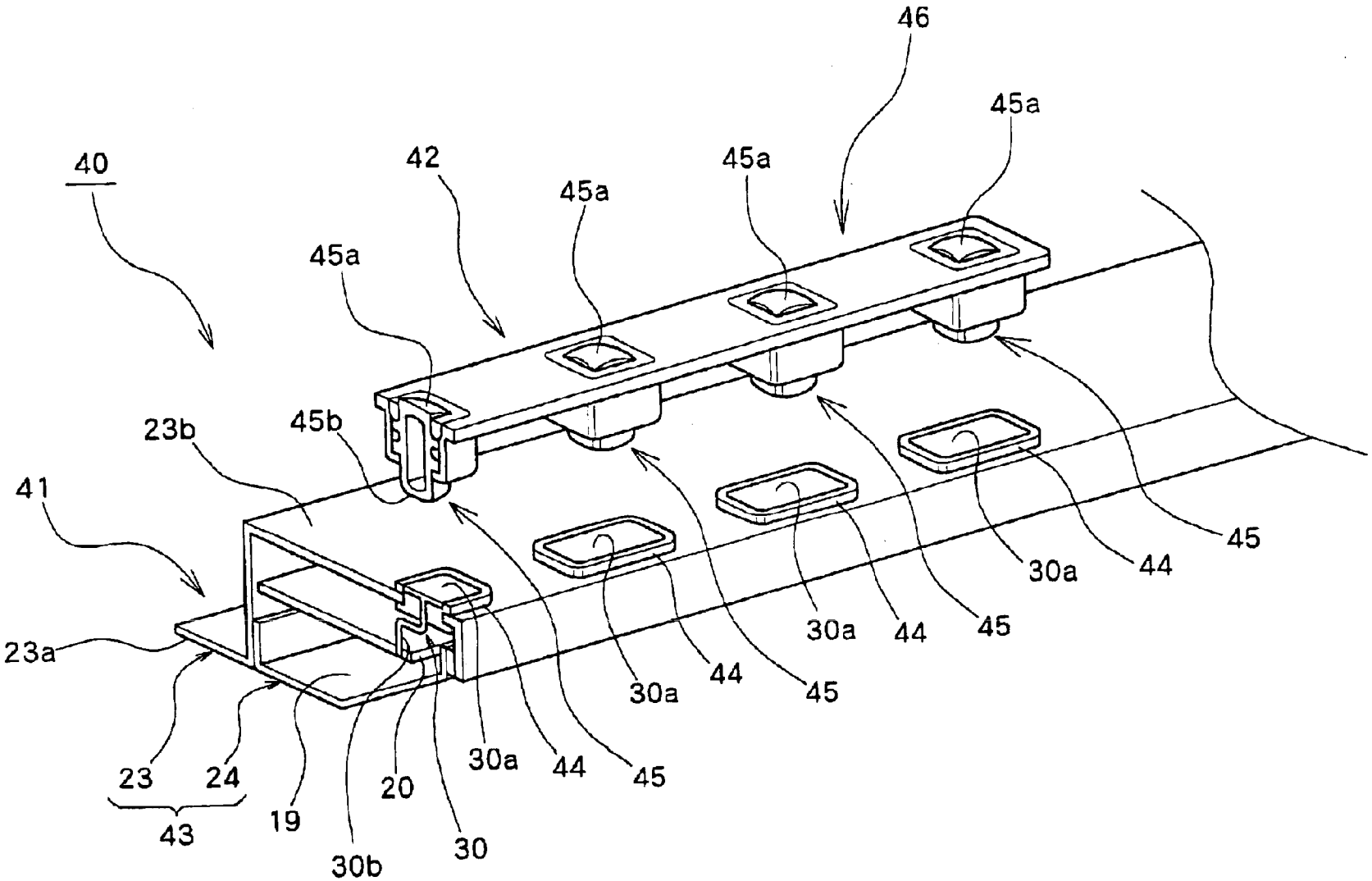
FIG. 6 is an exploded perspective view of a feeding unit in an antenna structure for a vehicle according to a third embodiment of the present invention.

FIG. 6 is an exploded perspective view illustrating an antenna structure according to a third embodiment of the present invention, especially a feeding unit thereof. In FIG. 6, the components corresponding to those in the above-described embodiments are labeled with the same numerals and characters, and description thereof will not be repeated.

While the feeding unit 17 is provided at a single amplifier case 18 fixed to the roof panel 11, i.e. the vehicle body, in the first and second embodiments, in the third embodiment a feeding unit 40 is divided into a panel side portion 41 and a glass side portion 42.

In the panel side portion 41, an amplifier case 43 fixed to the roof panel 11 is composed of the base 23 and the cover 24. The signal processing circuit 20 is provided in the inner space 19 of the amplifier case 43, and only the coupling member 30 connected to the signal processing circuit 20 is held by a shield packing 44 fit in the attachment flange 23*b* of the base 23.

On the other hand, in the glass side portion 42, a second contact member 45 formed of a conductive rubber or the like as an elastic conductive piece is held by a shield holder 46 fixable (with an adhesive, two-sided tape, or the like) to the rear window glass 12. One side 45*a* of the second contact member 45 resiliently contacts the first contact member 16, and the other side 45*b* thereof resiliently contacts the head 30*a* of the coupling member 30, thereby securing electrical connection.

Figure 7:
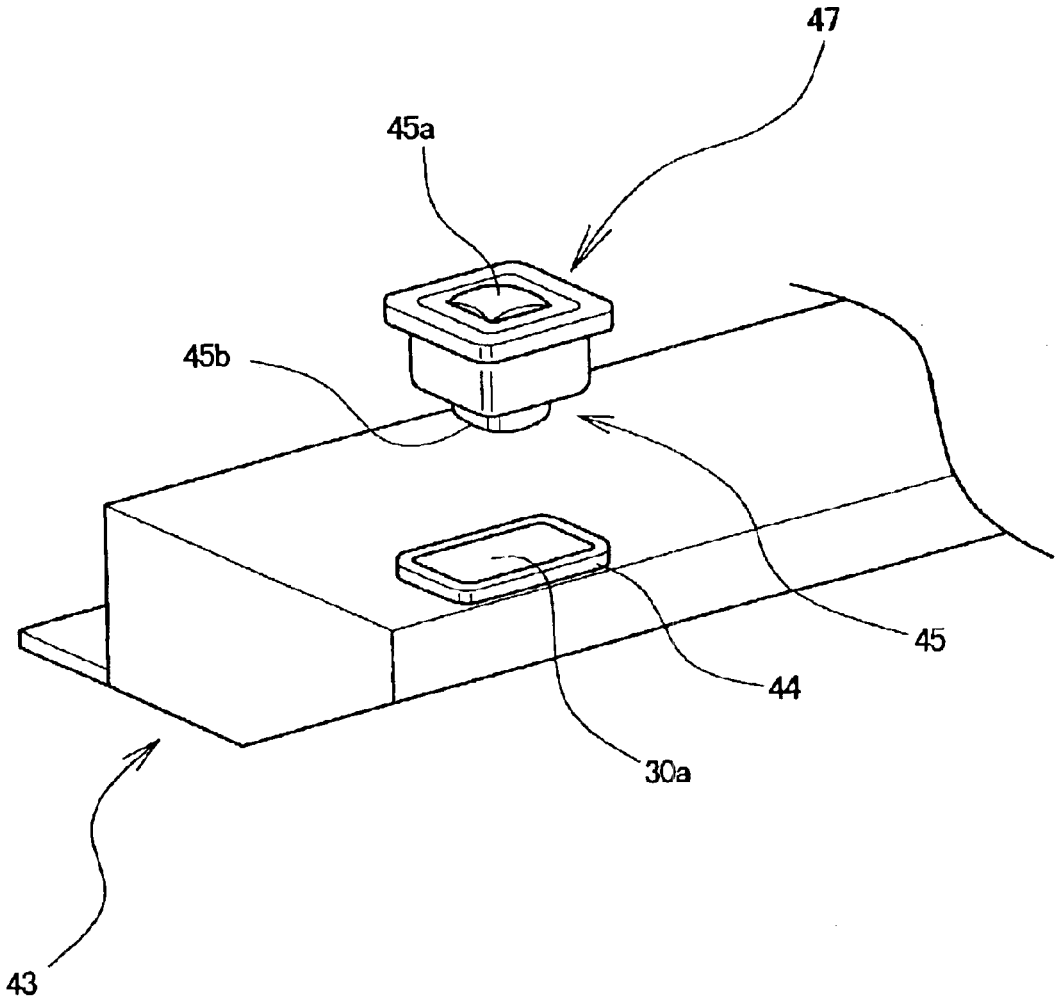
FIG. 7 is an exploded perspective view of a feeding unit in an antenna structure for a vehicle according to a variation of the third embodiment of the present invention.

Alternatively, a single second contact member 45 held in the shield holder 47 in the glass side portion 42 may be used, as illustrated in FIG. 7. In such a case, the other associated contact members, such as the first contact member 16 and the coupling member 30, are also provided in singles.

Other features, such as a fixing configuration and a shielding function of the amplifier case 18 disclosed in connection with the above-described first embodiment, are also employed for the amplifier case 43, and the functions of the structure other than the separately held coupling member 30 and the second contact member 45 are the same as those in the first embodiment.

By thus separately providing the feeding unit 17, the vehicle antenna structure can be divided into the panel side portion 41 and the glass side portion 42 which are mounted separately and then combined, thereby offering a wider variety in possible configurations and assembly options for the vehicle antenna structure, and therefore contributing to improved workability.

[Fourth Embodiment]

Figure 8:
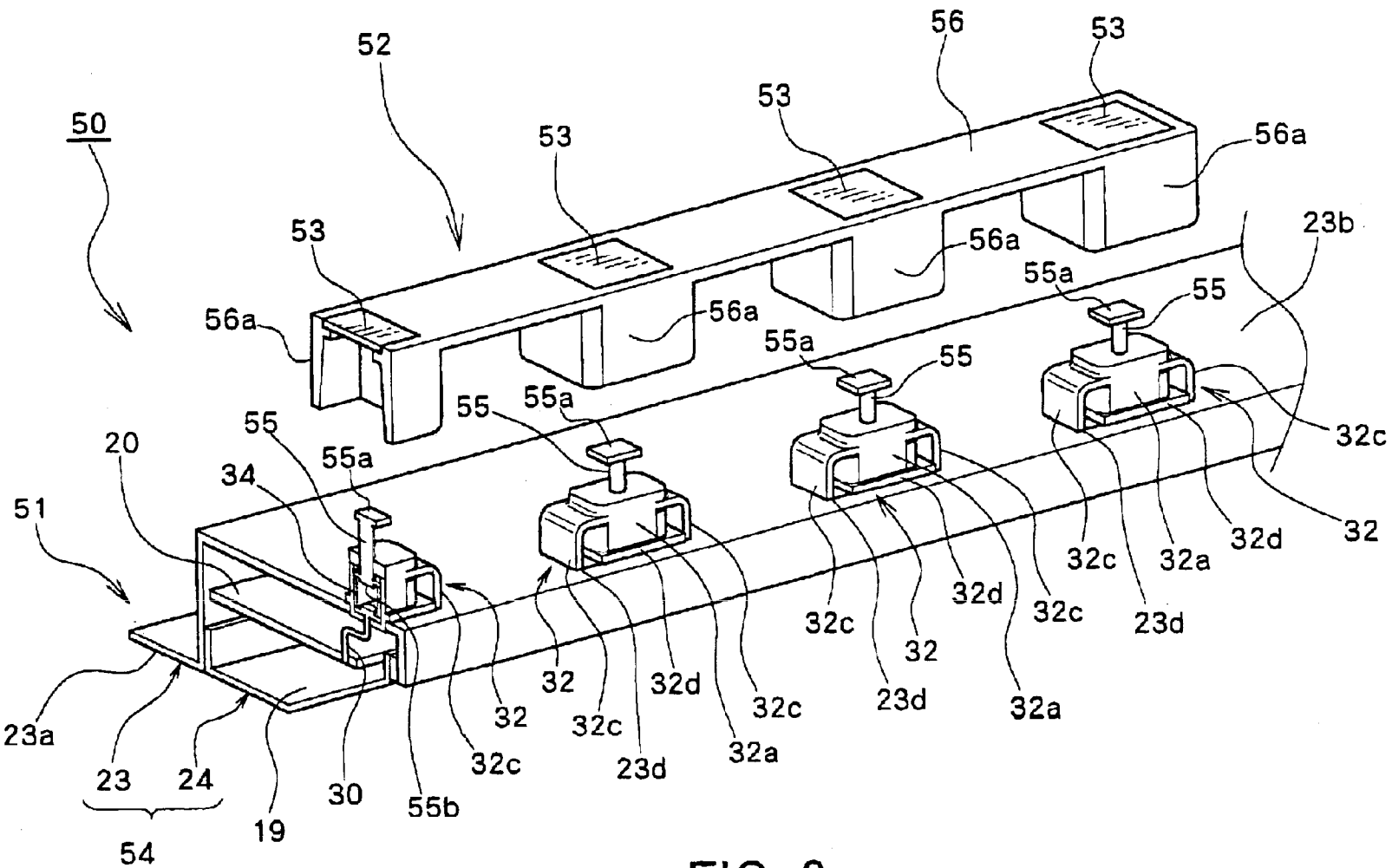
FIG. 8 is an exploded perspective view of a feeding unit in an antenna structure for a vehicle according to a fourth embodiment of the present invention.

FIG. 8 is an exploded perspective view illustrating an antenna structure according to a fourth embodiment of the present invention, especially the feeding unit. In FIG. 8, the components corresponding to those in the above-described embodiments are labeled with the same numerals and characters, and description thereof will not be repeated.

While in the first through third embodiments the second contact members 29, 33, and 45 are brought into direct contact with the first contact member 16, in the fourth embodiment a feeding unit 50 is divided into a panel side portion 51 and a glass side portion 52 as in the third embodiment, and the member contacts through a conductive rubber 53 provided on the glass side 52.

In the panel side portion 51, an amplifier case 54 fixed to the roof panel 11 is composed of a base 23 and a cover 24. The signal processing circuit 20 is provided in the inner space 19 of the amplifier case 54, which holds a holder 32 for holding the coupling member 30 connected to the signal processing circuit 20, a second contact member 55 formed of a conductive material as a conductive piece and having a cross section substantially in a horizontal H-shape, and the coil spring 34.

On the other hand, in the glass side portion 52, a shield holder 56 for holding the conductive rubber 53 and having a cylinder 56*a* covering the holder 32 is fixed to the window glass 12 (with an adhesive, two-sided tape, or the like), and one end 55*a* of the second contact member 55 is electrically connected to the first contact member 16 through the conductive rubber 53, so that the other end 55*b* of the second contact member 55 is electrically connected to the head 30*a* of the coupling member 30 through the coil spring 34.

Figure 9:
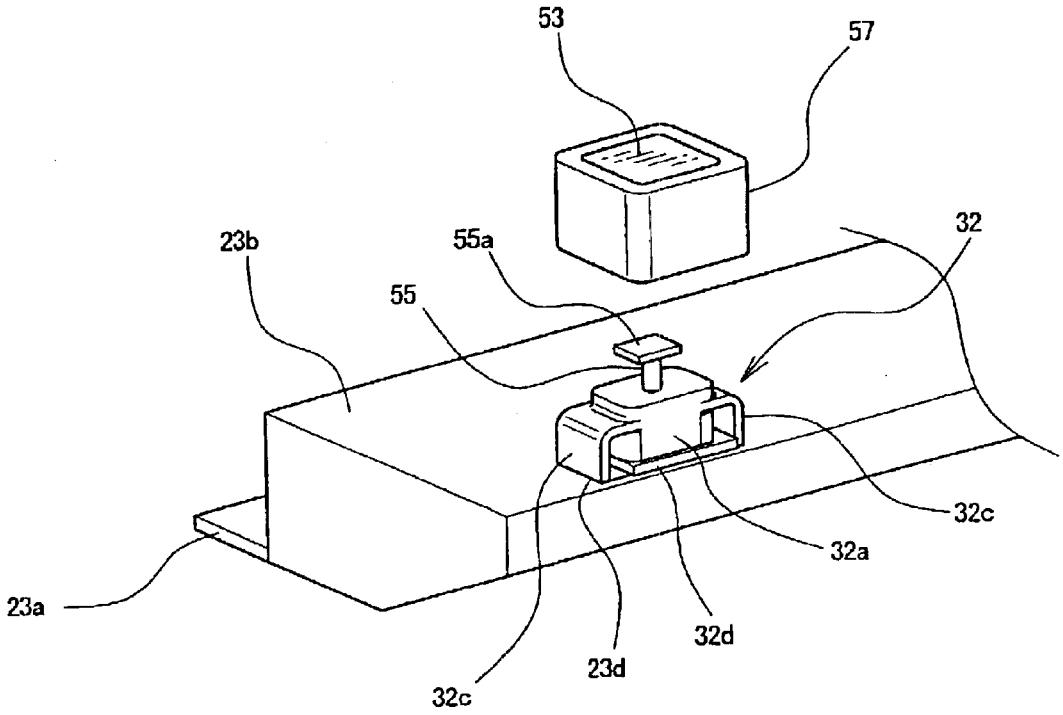
FIG. 9 is an exploded perspective view of a feeding unit in an antenna structure for a vehicle according to a variation of the fourth embodiment of the present invention.

Alternatively, a single conductive rubber 53 held in a shield holder 57 on the glass side 52 may be used, as illustrated in FIG. 9. In such a case, one each of the other associated contact members, such as the first contact member 16, the holder 32, and the coupling member 30, are also provided.

The remaining features, such as a fixing configuration and a shielding function of the amplifier case 18 disclosed in connection with the above-described first embodiment, are also employed for the amplifier case 54, and the functions of the structure other than the interposed conductive rubber 53 are naturally the same as those in the first embodiment.

By thus interposing the conductive rubber 53, chatter at the contact portion associated with vibration of the vehicle can further be prevented.

When fixing the shield holder 56 to the rear window glass 12 by, for example, an adhesive or two-sided tape, the cylinder 56*a* encloses the holder 32 to prevent entry of an adhesive into the conductive rubber 53 or the first contact member 16 even when the adhesive for fixing the rear window glass 12 is conductive. In other words, adverse effects on antenna performance can be prevented. Further, a gap between the rear window glass and the surrounding portion of the conductive rubber 53 can be sealed, thereby preventing entry of moisture, such as associated with dew or condensation, or wind into the area surrounding the contact portion of the conductive rubber 53.

The adhesive, two-sided tape, or the like need not be applied all around the conductive rubber 53 because entry of adhesive or moisture along the rear window glass can be prevented by application just at the upper portion.

While the feeding units 17, 40, and 50 are provided at the border between the roof panel 11 and the rear window glass 12 in the above embodiments, the feeding units may be provided at any location, such as the border between a side window glass and the vehicle body panel inside the trunk room trim (side wall of the vehicle), or the border between the rear panel (or rear hatch panel) and the lower side of the rear window glass. Further, while the first contact member 16 and the feeding units 17, 40, and 50 are horizontally divided and disposed in the above description, they may alternatively be disposed at the center of the vehicle.

What is claimed is:

1. An antenna structure for a vehicle, comprising:

an antenna element disposed on a window glass of the vehicle;

a first contact member disposed at one end of said antenna element;

an amplifier case fixed to a body panel of the vehicle, and having at least a portion facing said window glass; and a signal processing circuit disposed in said amplifier case at the portion facing said window glass, and connectable to said first contact member.

2. An antenna structure for a vehicle according to claim 1, wherein said first contact member and said signal processing circuit are electrically connected through a second contact member formed of a conductive element.

3. An antenna structure for a vehicle according to claim 2, wherein said second contact member is resilient.

4. An antenna structure for a vehicle according to claim 3, wherein said second contact member is formed as an elastic bellows.

5. An antenna structure for a vehicle according to claim 2, wherein said second contact member is made to contact said first contact member by a conductive pressing element.

6. An antenna structure for a vehicle according to claim 5, wherein said pressing element is a coil spring.

7. An antenna structure for a vehicle according to claim 2, wherein a conductive rubber is disposed between said first and second contact members.

8. An antenna structure for a vehicle according to claim 1, wherein said amplifier case is a shield case for preventing adverse effects of noise on at least said signal processing circuit.

9. An antenna structure for a vehicle according to claim 1, wherein said second contact member is covered with a protective member formed of an insulating material.

* * * * *

UNITED STATES PATENT AND TRADEMARK OFFICE

CERTIFICATE OF CORRECTION

PATENT NO. : 6,825,812 B2
DATED : November 30, 2004
INVENTOR(S) : Makoto Yokota et al.

It is certified that error appears in the above-identified patent and that said Letters Patent is hereby corrected as shown below:

Title page,
Item [73], Assignees, please delete the following:

"[73] Assignees: Kojima Press Industry Co., LTD. Toyota (JP); Jidosha Kabushiki Kaisha, Toyota (JP); Asahi Glass Company, Limited, Toyota (JP); Nippon Sheet Glass Company, Osaka (JP); Fujitsu Ten Limited, Kobe (JP)"

and replace with:

-- [73] Assignees: Kojima Press Industry Co., LTD. Toyota (JP); Toyota Jidosha Kabushiki Kaisha, Toyota (JP); Asahl Glass Company, Limited, Toyota (JP); Nippon Sheet Glass Company, Limited, Osaka (JP); Fujitsu Ten Limited, Kobe (JP) --

Signed and Sealed this

Nineteenth Day of April, 2005

JON W. DUDAS
*Director of the United States Patent and Trademark Office*